US009623286B1

(12) United States Patent
Chen

(10) Patent No.: US 9,623,286 B1
(45) Date of Patent: Apr. 18, 2017

(54) STAIR-CLIMBER

(71) Applicant: HEALTHSTREAM TAIWAN INC., Taoyuan (TW)

(72) Inventor: Chun-Ting Chen, Taoyuan (TW)

(73) Assignee: HEALTHSTREAM TAIWAN INC., Taoyuan (TW)

( * ) Notice: Subject to any disclaimer, the term of this patent is extended or adjusted under 35 U.S.C. 154(b) by 0 days.

(21) Appl. No.: 14/990,153

(22) Filed: Jan. 7, 2016

(30) Foreign Application Priority Data

Nov. 11, 2015 (TW) ..... 104137147 A

(51) Int. Cl.
*A63B 24/00* (2006.01)
*A63B 22/04* (2006.01)

(52) U.S. Cl.
CPC ..... *A63B 24/0062* (2013.01); *A63B 22/04* (2013.01); *A63B 24/0087* (2013.01)

(58) Field of Classification Search
CPC . A63B 24/00; A63B 24/0062; A63B 24/0087; A63B 22/04
See application file for complete search history.

(56) References Cited

U.S. PATENT DOCUMENTS 6,482,130 B1 * 11/2002 Pasero ..... A63B 22/001 482/51
6,749,540 B1 * 6/2004 Pasero ..... A63B 22/001 482/52
6,939,271 B1 * 9/2005 Whan-Tong ..... A63B 22/001 482/52
7,691,034 B2 * 4/2010 May ..... A63B 22/0012 482/52
7,815,549 B2 * 10/2010 Crawford ..... A63B 24/0087 482/52
2007/0254778 A1 * 11/2007 Ashby ..... A63B 22/001 482/5

* cited by examiner

*Primary Examiner* — Glenn Richman
(74) *Attorney, Agent, or Firm* — Muncy, Geissler, Olds & Lowe, P.C.

(57) ABSTRACT

A stair-climber includes a base, a first inclination unit, a second inclination unit, a step unit, and a sensor. The front end of the first inclination unit is slidably disposed at the base. The second inclination unit is pivotally connected to the rear end of the first inclination unit. The rear end of the second inclination unit is pivotally connected to the base. The inclination angle of the second inclination unit is adjusted by an inclination unit regulator disposed between the first and second inclination units. The step unit is disposed at the second inclination unit and has multiple steps. The steps undergo angle adjustment with a step regulator disposed at the second inclination unit and thus tilt at angles suitable for a tread performed by users ergonomically. The sensor is disposed at the rear end of the second inclination unit to detect whether the users have lost footing.

10 Claims, 9 Drawing Sheets

STAIR-CLIMBER

BACKGROUND OF THE INVENTION

1. Technical Field

The present invention relates to fitness equipment and more particularly to a stair-climber with an adjustable inclination angle.

2. Description of Prior Art

Many people nowadays are too busy to engage in outdoor sports. Moreover, outdoor sports are weather-dependent. Therefore, to be free from the aforesaid time-related and weather-related restraints, sporty people often have a fitness device at home and use it at any time to promote their physical fitness.

To meet different users' needs, there are presently plenty of fitness devices with various functions for users to choose from, such as treadmills, steppers, elliptical trainers, and stair-climbers. Take a stair-climber as an example, it enables a user to simulate climbing steps through cyclical movement of the steps so as to build muscle and boost cardiopulmonary performance. However, the climbing slopes of conventional stair-climbers are usually invariable and thus unadjustable, thereby not meeting users' workout needs. As a result, the users benefit little from conventional stair-climbers in terms of physical fitness enhancement.

SUMMARY OF THE INVENTION

It is an objective of the present invention to provide a stair-climber capable of adjusting an inclination angle to change a climbing slope, meet different workout needs, and enhance user safety during workout.

In order to achieve the above and other objectives, the present invention provides a stair-climber which comprises a base, a first inclination unit, a second inclination unit, an inclination unit regulator, a step unit, a step regulator, a sensor, and a control unit. The front end of the first inclination unit is disposed at the front end of the base and slidable forward and backward. The bottom surface of the second inclination unit is pivotally connected to the rear end of the first inclination unit. The rear end of the second inclination unit is pivotally connected to the rear end of the base. The inclination unit regulator is disposed between the front end of the first inclination unit and the front end of the second inclination unit to adjust the inclination angle of the second inclination unit relative to the base. The step unit is disposed at the second inclination unit and has a driving source and multiple steps pivotally rotatable relative to the second inclination unit. The step regulator is disposed at the second inclination unit and connected to the steps of the step unit such that the steps are each oriented at a specific angle relative to the second inclination unit. The sensor is disposed at the rear end of the second inclination unit to sense a user's feet on the multiple steps and send a sensing signal. The control unit is electrically connected to the driving source of the step unit and the sensor to receive the sensing signal of the sensor and determine, with reference to a sensing result, whether to stop the driving source from operating.

Therefore, to operate the stair-climber, the user adjusts the inclination angle of the inclination unit with the inclination unit regulator and then adjusts the angles of the steps with the step regulator such that the user can take exercise while treading on different climbing slopes with correct and comfortable postures. During workout, the sensor is triggered to send a sensing signal to a control unit as soon as the user loses his or her footing, such that the control unit stops a driving source of the step unit from operating, thereby enhancing user safety.

DETAILED DESCRIPTION OF THE EMBODIMENT OF THE INVENTION

Figure 1:
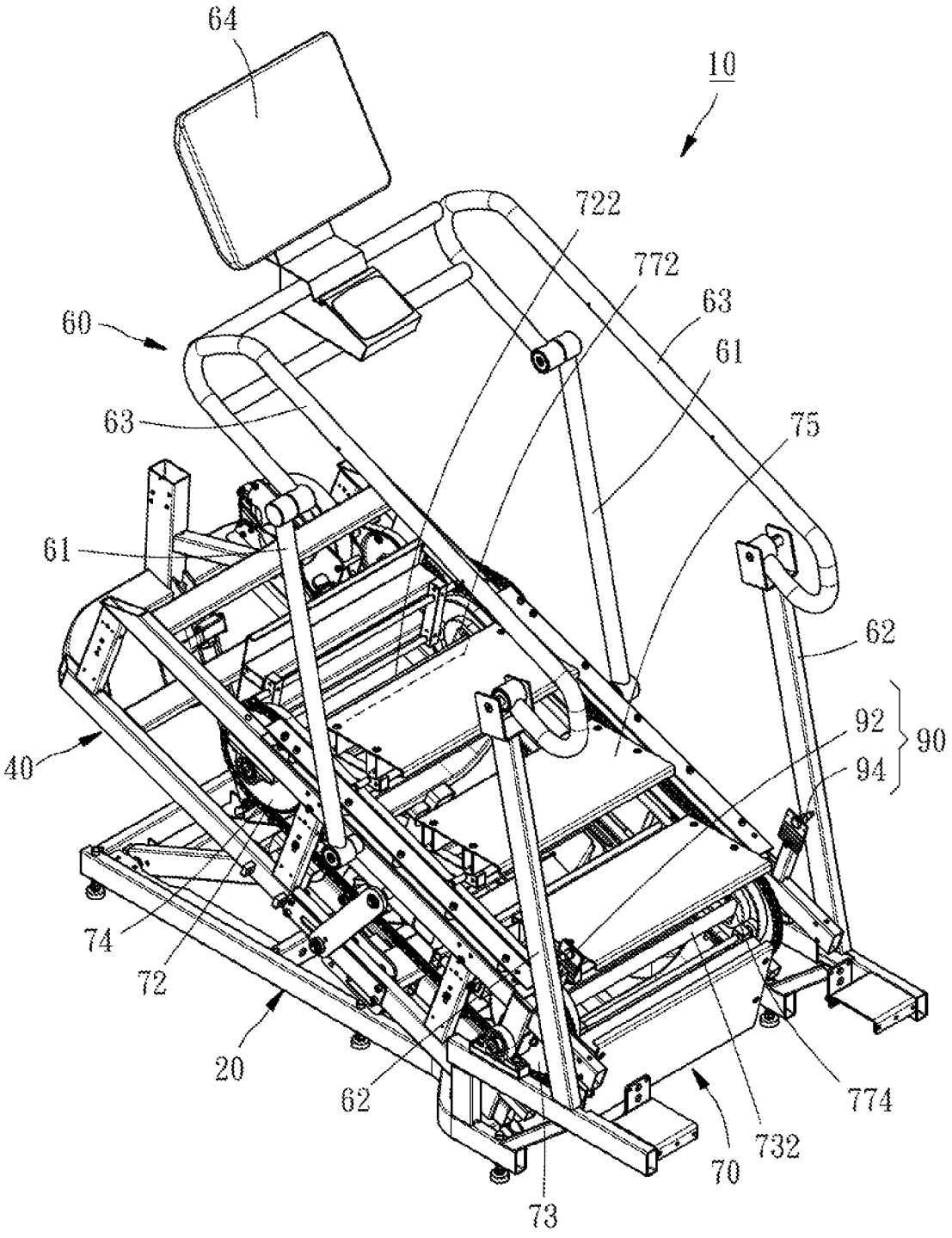
FIG. 1 is a perspective view of a stair-climber of the present invention.

Referring to FIGS. 1, 2, 5 and 9, a stair-climber 10 of the present invention comprises a base 20, a first inclination unit 30, a second inclination unit 40, an inclination unit regulator 50, a handrail unit 60, a step unit 70, a step regulator 80, a sensor 90, and a control unit 64.

Figure 5:
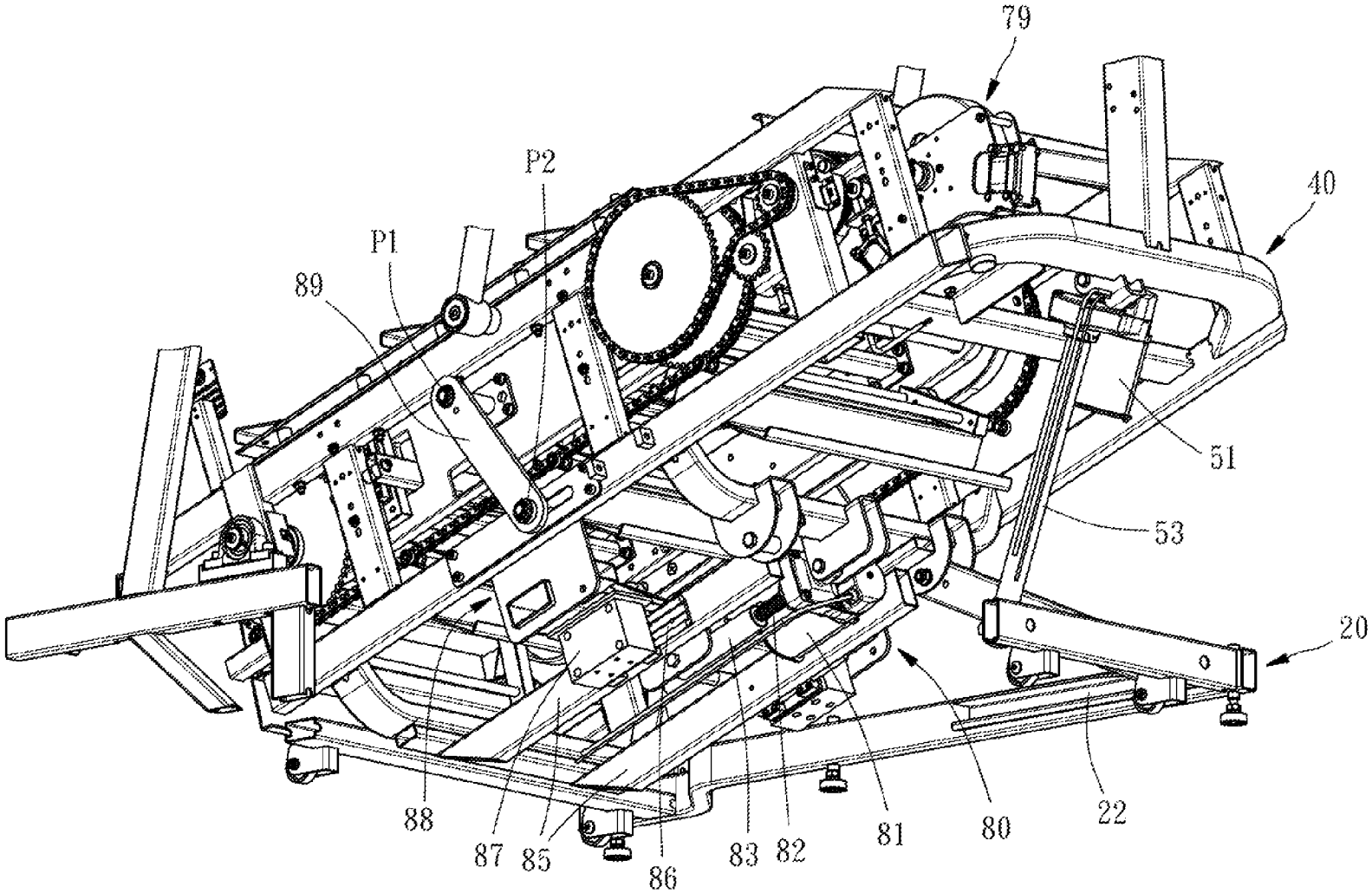
FIG. 5 is another partial perspective view of the stair-climber of the present invention, showing the fine structures of the step regulator.

The base 20 is placed on the ground to underpin the other aforesaid components of the stair-climber 10. Referring to FIG. 5, two opposing sliding grooves 22 are disposed on the inner sides of the base 20.

Figure 3:
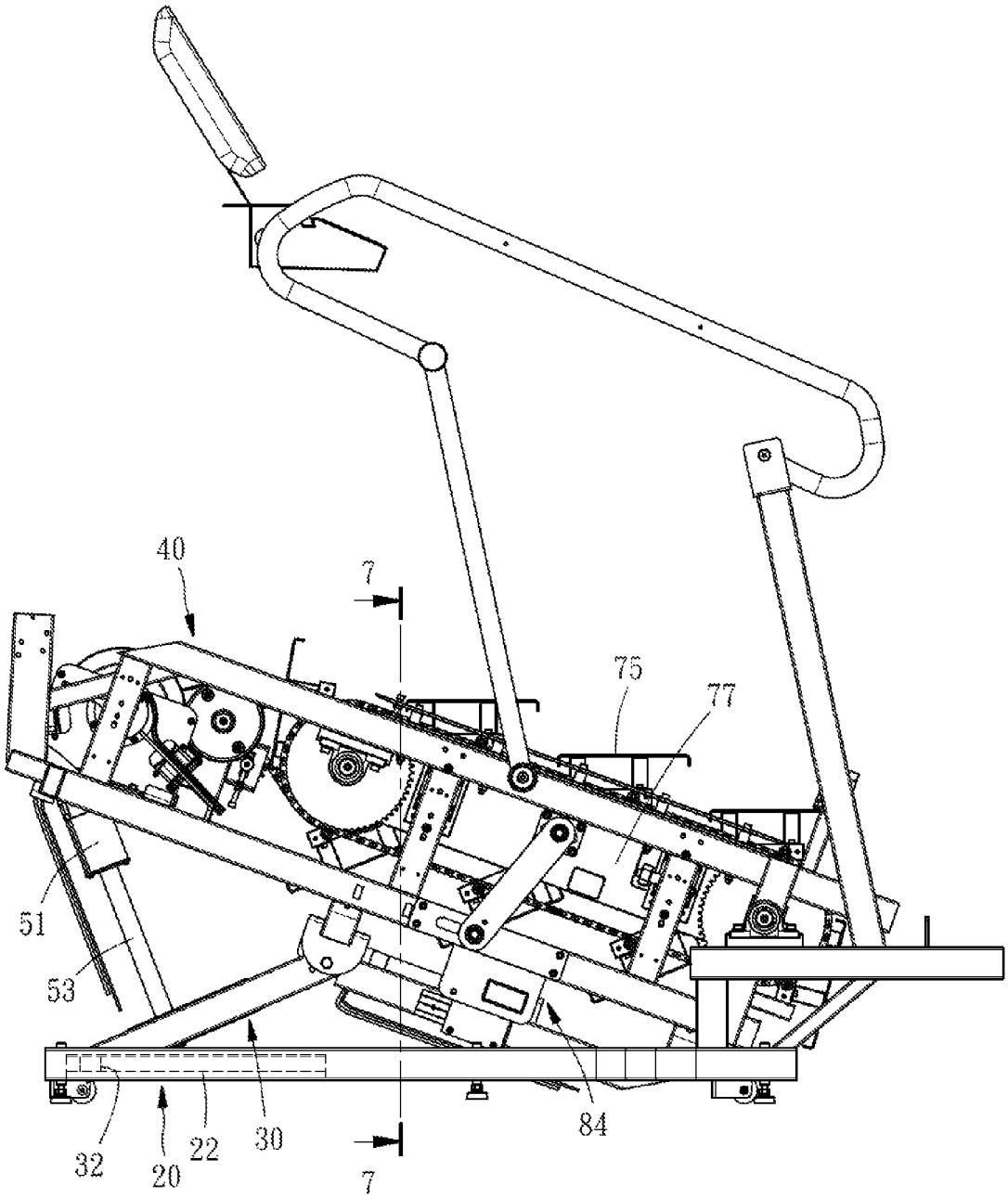
FIG. 3 is a lateral view of the stair-climber of the present invention.
Figure 9:
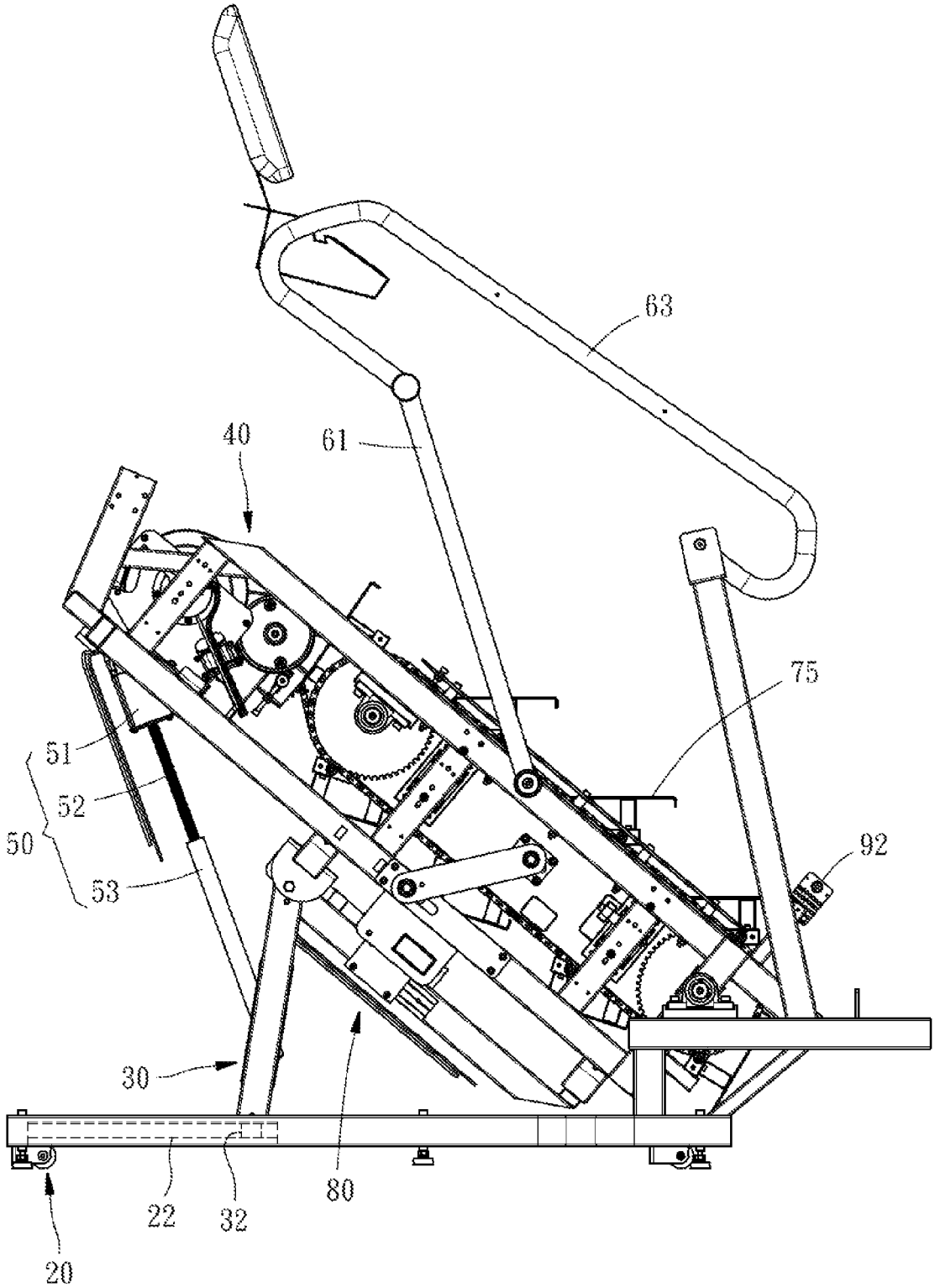
FIG. 9, which is similar to FIG. 3, shows the status of the second inclination unit after the inclination angle has been adjusted.

The front end of the first inclination unit 30 is disposed in the sliding grooves 22 of the base 20 through two opposing sliding blocks 32, as shown in FIG. 3 and FIG. 9, such that the first inclination unit 30 slides forward and backward relative to the base 20.

The bottom surface of the second inclination unit 40 is pivotally connected to the rear end of the first inclination unit 30. The rear end of the second inclination unit 40 is pivotally connected to the rear end of the base 20.

Figure 2:
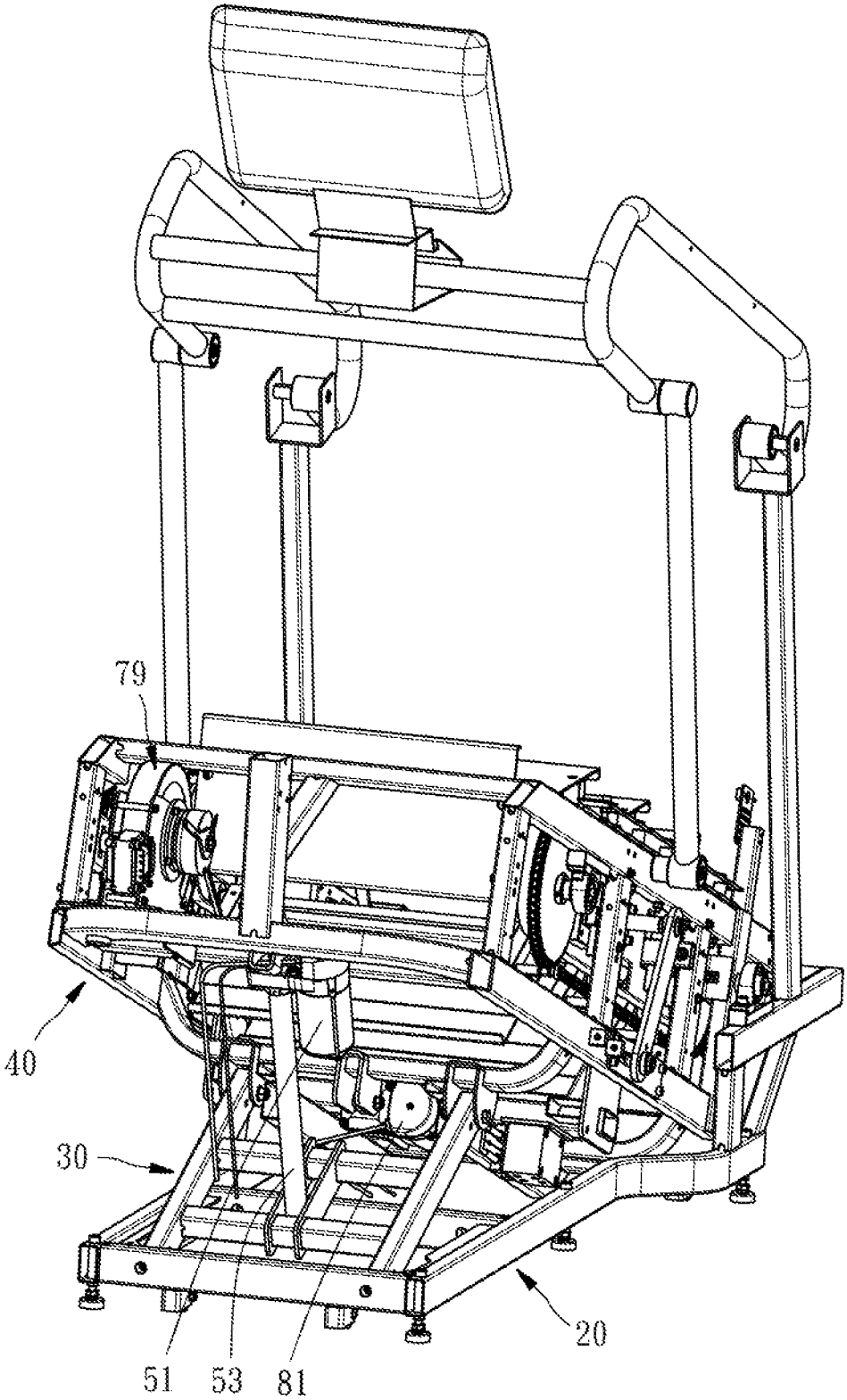
FIG. 2 is a perspective view taken from another view angle of the stair-climber according to the present invention.

Referring to FIG. 2 and FIG. 9, the inclination unit regulator 50 has a first motor 51, a first bolt 52, and a first sleeve 53. The first motor 51 is pivotally connected to the front end of the second inclination unit 40. The top end of the first bolt 52 is connected to the first motor 51. The first sleeve 53 is screwed to the first bolt 52. The bottom end of the first sleeve 53 is pivotally connected to the front end of the first inclination unit 30. Therefore, when the first motor 51 drives the first bolt 52 to rotate, the first sleeve 53 moves axially along the first bolt 52. The vertical motion of the first sleeve 53 further drives the first inclination unit 30 to slide forward and backward relative to the base 20, such that the inclination angle of the second inclination unit 40 relative to the base 20 can be adjusted by the forward and backward motion of the first inclination unit 30.

The handrail unit 60 has two opposing movable upright rods 61, two opposing fixed upright rods 62, and two opposing handrail rods 63. The bottom end of each movable upright rod 61 is pivotally connected to the middle of the second inclination unit 40. The bottom end of each fixed upright rod 62 is fixed to the rear end of the base 20 and positioned behind the corresponding one of the movable upright rods 61. The handrail rods 63 are pivotally connected to the top ends of the movable upright rods 615 and the top ends of the fixed upright rods 62. Therefore, by lifting and lowering the second inclination unit 40, the handrail unit 60 can be adjusted to be oriented at a specific angle suitable for a grip.

Figure 4:
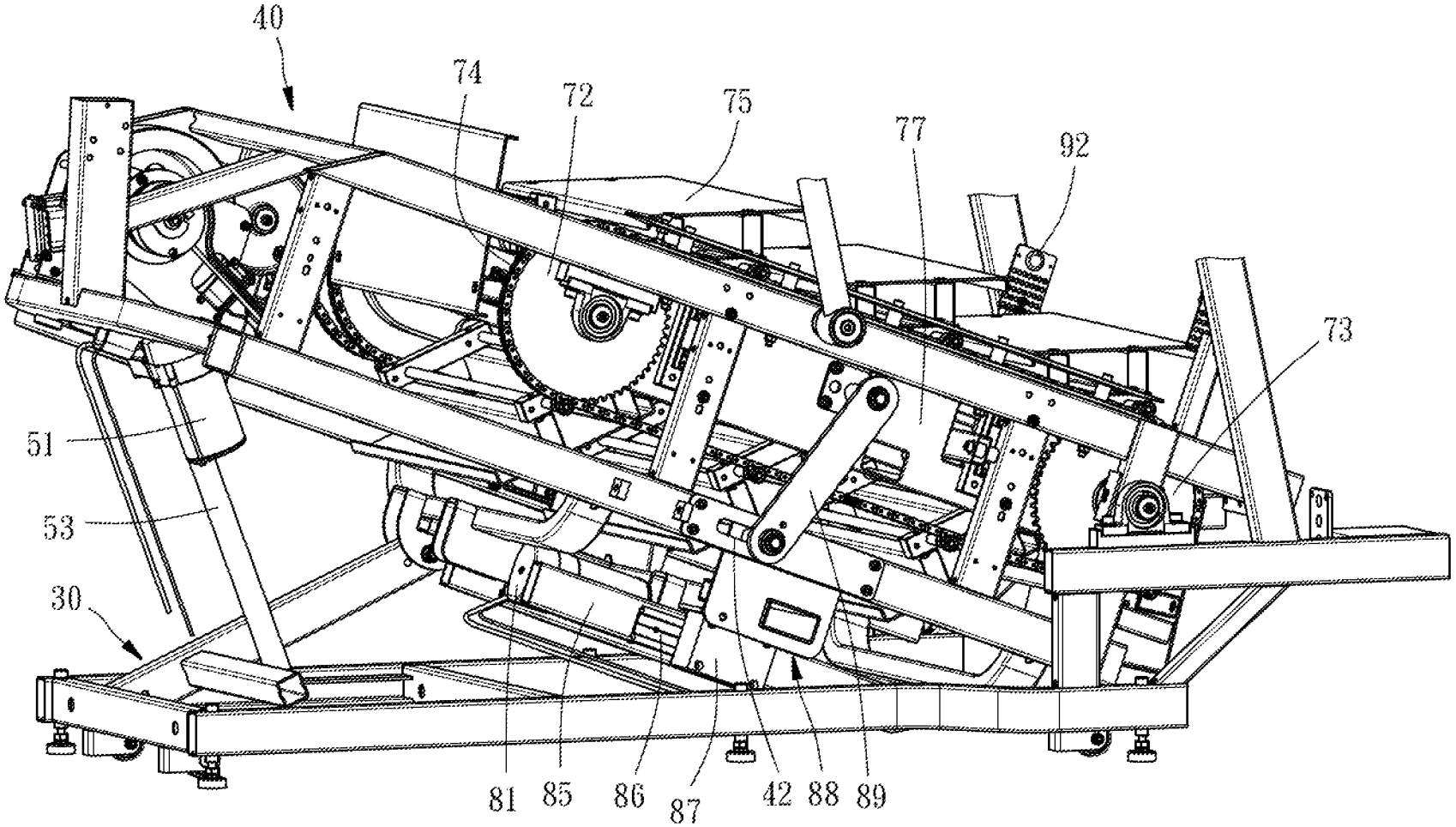
FIG. 4 is a partial perspective view of the stair-climber of the present invention, showing the fine structures of a step regulator.

Referring to FIG. 1 and FIG. 4, the step unit 70 has two opposing front sprockets 72, two opposing rear sprockets 73, two chains 74, and multiple steps 75 aligned one after the other. The two front sprockets 72 are fixed in place to the left and right of the front end of the second inclination unit 40 by a front axle 722. The two rear sprockets 73 are fixed in place to the left and right of the rear end of the second inclination unit 40 by a rear axle 732. The chains 74 each wind round the front and rear sprockets 72, 73 on the same side, such that the front and rear sprockets 72, 73 rotate synchronously. The steps 75 are pivotally connected to the two chains 74 by a step shaft 752, such that the steps 75 are not only driven by the chains 74 to move cyclically but are also pivotally rotated relative to the second inclination unit 40 upward and downward. Furthermore, the step unit 70 has a driving source 79. The driving source 79 is mounted at the front end of the second inclination unit 40 and connected to one of the front sprockets 72 to thereby serve as a power source.

Figure 7:
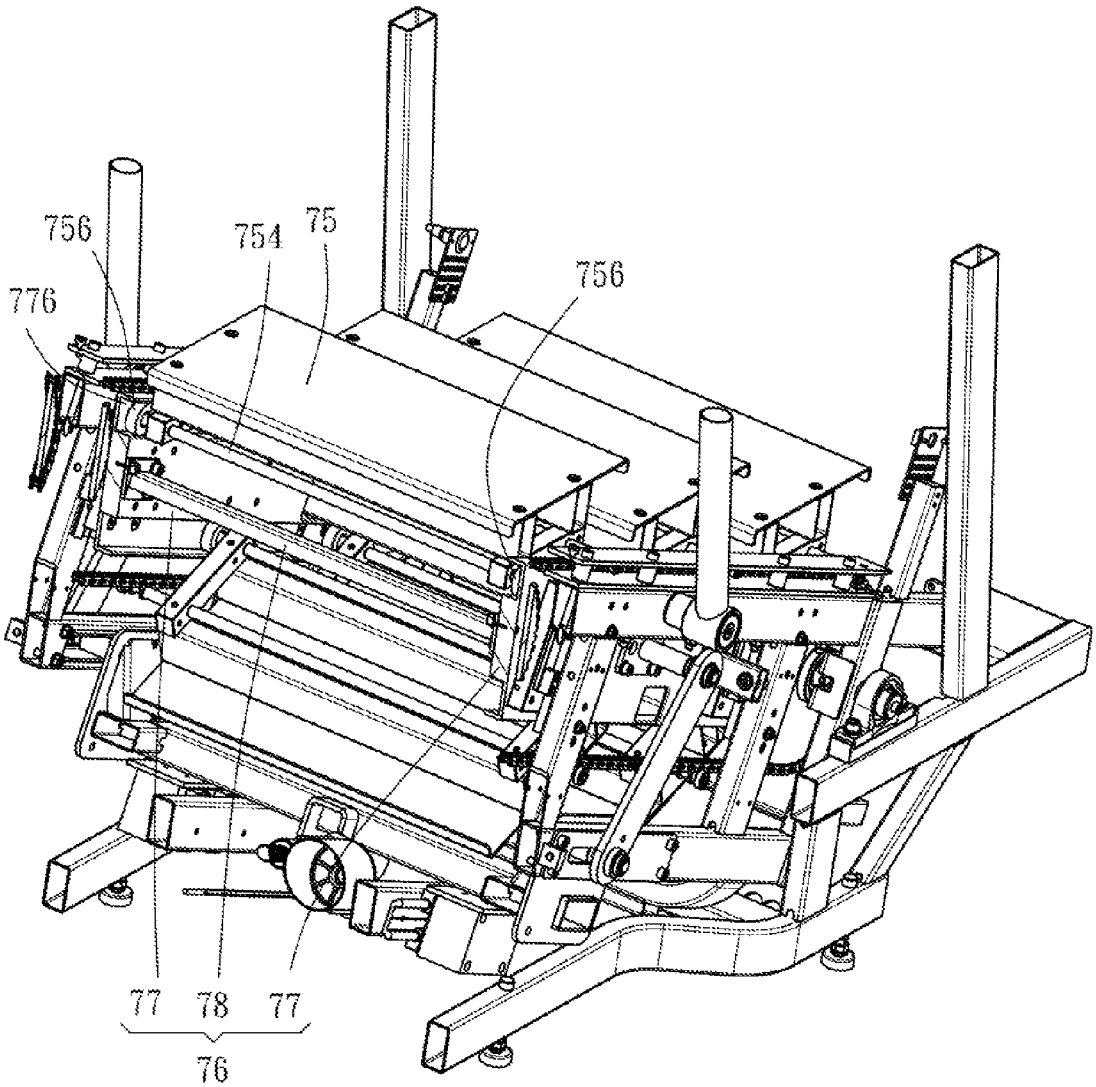
FIG. 7 is a cross-sectional view of the stair-climber taken along line 7-7 of FIG. 3, showing the structural relationship between a step and a step adjustment frame.
Figure 8:
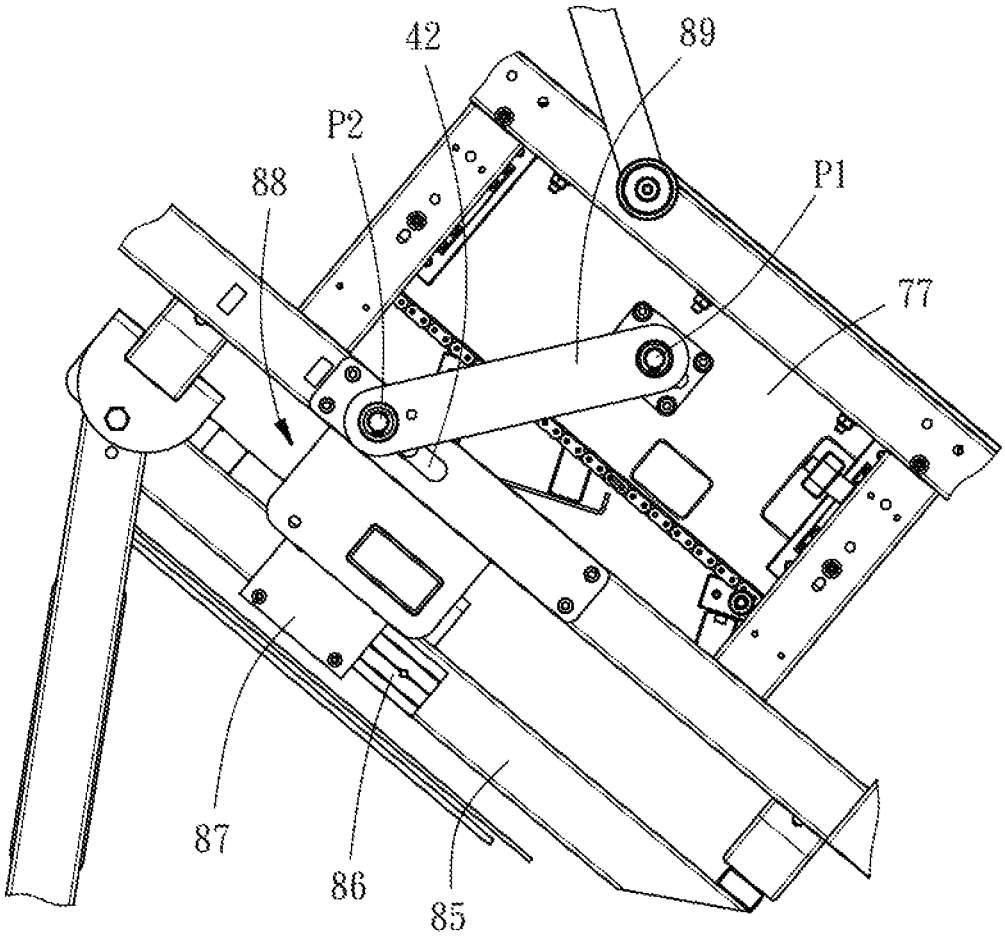
FIG. 8, which is similar to FIG. 6, shows the status of the bracket after a second inclination unit has been lifted.

Referring to FIG. 7, the step unit 70 further has a step adjustment frame 76. The step adjustment frame 76 has two opposing lateral boards 77. The two lateral boards 77 are connected by two support rods 78. The front end of each lateral board 77 has a front axial hole 772 (shown in FIG. 1) penetrated by the front axle 722. The diameter of the front axial hole 772 is larger than the outer diameter of the front axle 722. The rear end of each lateral board 77 has a rear axial hole 774 (shown in FIG. 1) penetrated by the rear axle 732. The diameter of the rear axial hole 774 is larger than the outer diameter of the rear axle 732 such that, when driven, the lateral boards 77 can move upward and downward relative to the first inclination unit 30. Referring to FIG. 7, a guide slot 776 is disposed on the inner side of each lateral board 77. The steps 75 are each connected to the lateral boards 77 by a guide rod 754. A guide wheel 756 is mounted at each of the two ends of the guide rod 754. The guide wheels 756 are rotatably inserted into the guide slots 776 of the lateral boards 77, respectively, to not only increase the stability of the recurring operation of the steps 75 but also allow the steps 75 to synchronize with the step adjustment frame 76.

Figure 6:
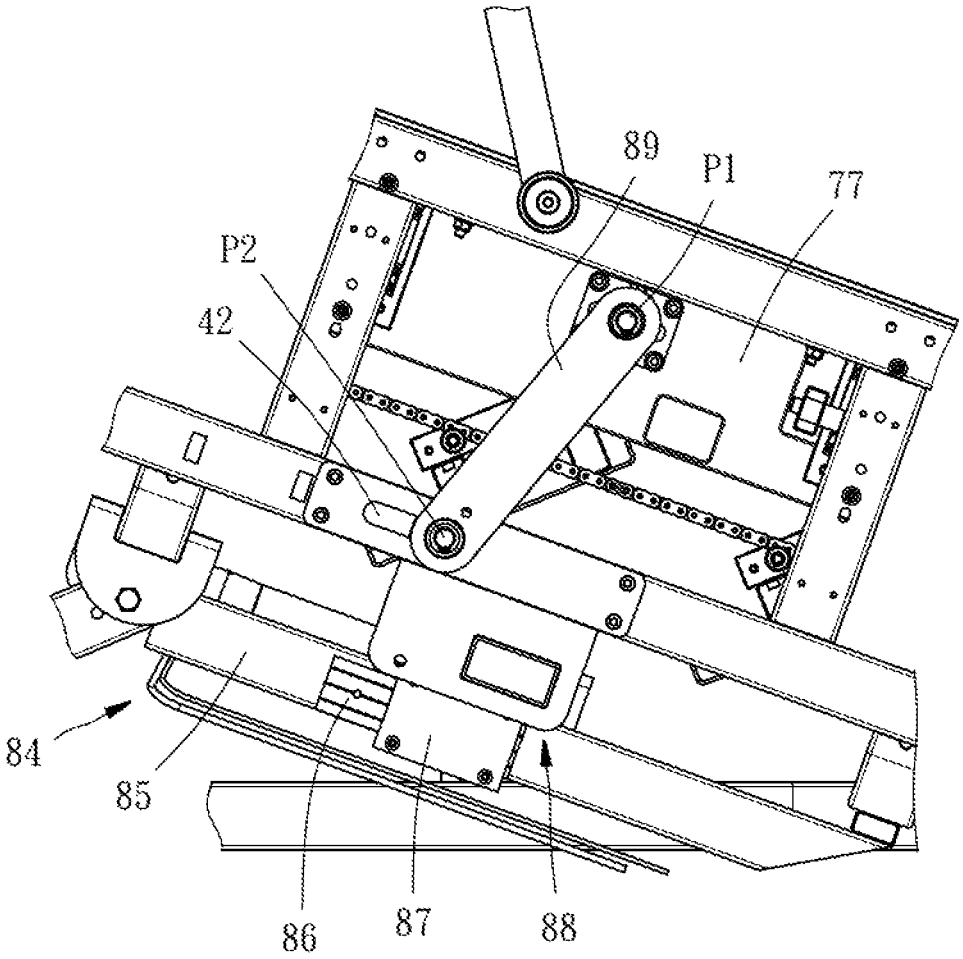
FIG. 6 is a partial enlarged view of a bracket of the stair-climber of the present invention.

Referring to FIG. 4 through FIG. 6, the step regulator 80 has a second motor 81, a second bolt 82, and a second sleeve 83. The second motor 81 is pivotally connected to the second inclination unit 40. The front end of the second bolt 82 is connected to the second motor 81, The second sleeve 83 is screwed to the second bolt 82, such that, when the second motor 81 drives the second bolt 82 to rotate, the second sleeve 83 moves forward and backward in the axial direction of the second bolt 82. Furthermore, the step regulator 80 further has a bracket 84. The bracket 84 has two parallel rail holders 85, two parallel rails 86, two opposing slide tables 87, a linkage unit 88, and two opposing linkage arms 89. The rail holders 85 are disposed on the bottom surface of the second inclination unit 40. The rear ends of the rail holders 85 are fixed to the rear end of the second inclination unit 40. The rails 86 are disposed on the external lateral sides of the rail holders 85. The slide tables 87 are disposed at the rails 86 and slidable forward and backward. The linkage unit 88 is connected to the top sides of the two slide tables 87 and pivotally connected to the rear end of the second sleeve 83. The top end and bottom end of the linkage arms 89 are pivotally connected to the lateral boards 77 of the step adjustment frame 76 and one end of the linkage unit 88 by a first pivot P1 and a second pivot P2, respectively. The second pivot P2 is penetratingly disposed in a limiting slot 42 of the second inclination unit 40 and slidable forward and backward.

Referring to FIG. 1, the sensor 90 is mounted at the rear end of the second inclination unit 40 to sense a user's feet on the steps 75. In this embodiment, the sensor 90 is exemplified by an optical breaker and comprises a light-emitting component 92 and a light-receiving component 94. Any break in the light path between the light-emitting component 92 and the light-receiving component 94 indicates that the user's foot is incorrectly placed on a step, and thus the sensor 90 sends a sensing signal.

The control unit 64 is mounted at the front end of the handrail rods 63 and electrically connected to the driving source 79 of the step unit 70 and the sensor 90. The control unit 64 stops the step unit 70 from operating as soon as the control unit 64 receives the sensing signal from the sensor 90.

To change the climbing slope, the user starts the first motor 41 such that the first motor 41 drives the first bolt 42 to push the first inclination unit 30 through the first sleeve 53, and in consequence the first inclination unit 30 drives the second inclination unit 40 to deflect relative to the base 20. Referring to FIG. 9, with the second inclination unit 40 being deflected at different angles, the climbing slope is adjusted until an appropriate angle is attained. Afterward, the first motor 41 is shut down to allow the second inclination unit 40 to stay still such that the user begins a workout by treading on the steps 75.

Since the second inclination unit 40 can tilt at different angles relative to the base 20, it is important to enable the user's hands to grip the handrail rods 63 ergonomically while treading on the steps 75. To this end, the handrail rods 63 and the movable upright rods 61 enable the user to adjust the handrail rods 63 to an appropriate position with reference to the inclination angle of the second inclination unit 40.

In another aspect of the present invention, since the steps 75 tilt slightly in accordance with different inclination angles of the second inclination unit 40, it is important that the steps 75 can still tilt at a specific angle conducive to the users' tread despite angular changes. To this end, as shown in FIG. 4 through FIG. 8, the present invention is characterized in that: the second motor 81 is started, such that the second bolt 82 is driven by the second motor 81; the second sleeve 83 pulls the linkage unit 88 to thereby not only drive the two slide tables 87 to slide forward along the rails 86 but also pull the bottom end of the linkage arms 89, such that the second pivot P2 moves forward along the limiting slot 42 of the second inclination unit 40, thereby allowing the linkage arms 89 to deflect; during the deflection of the linkage arms 89, the top ends of the linkage arms 89 pull the step adjustment frame 76 downward, such that the step adjustment frame 76 moves downward relative to the second inclination unit 40; during the movement of the step adjustment frame 76, due to the relation between each lateral board 77 and a corresponding one of the guide wheels 756, the steps 75 each rotate pivotally relative to the second inclination unit 40 such that the steps 75 are each oriented at a specific angle, for example, oriented horizontally or oriented at a small angle to the horizontal, conducive to the user's tread even though the inclination angle of the second inclination unit 40 has changed, thereby allowing the user to tread in a labor-saving manner.

To enable efficient and convenient operation of the stair-climber of the present invention, it is also feasible to allow the inclination unit regulator 50 to synchronize with the step regulator 80 by a means of electronic control such that, in response to a change in the inclination angle of the second inclination unit 40, the steps 75 undergo deflection to end up at a position favorable for taking exercise. In another aspect of the present invention, if the user loses his or her footing while treading on the steps 75 and thus hides the light path of the sensor 90, the control unit 64 will receive the sensing signal from the sensor 90 to stop the step unit 70 from operating, thereby reducing the likelihood that the user will get injured.

In conclusion, the stair-climber 10 of the present invention not only uses the inclination unit regulator 50 to adjust the inclination angle of the second inclination unit 40 but also uses the step regulator 80 to adjust the steps 75 to a specific angle conducive to a user's tread, so as for the user to take exercise while treading on different climbing slopes with correct and comfortable postures. The sensor 90 enhances user safety. The inclination unit regulator 50 synchronizes with the step regulator 80 by a means of electronic control. Hence, the user is always well-supported while operating the stair-climber of the present invention, thereby achieving the objective of the present invention.

What is claimed is:

1. A stair-climber, comprising:

a base;

a first inclination unit having a front end disposed at a front end of the base and slidable forward and backward;

a second inclination unit having a bottom surface pivotally connected to a top end of the first inclination unit and having a rear end pivotally connected to a rear end of the base;

an inclination unit regulator disposed between the front end of the first inclination unit and a front end of the second inclination unit;

a step unit disposed at the second inclination unit and having a driving source and multiple steps rotatable pivotally relative to the second inclination unit;

a step regulator disposed at the second inclination unit and connected to the steps of the step unit such that the steps are each oriented at a specific angle relative to the second inclination unit;

a sensor disposed at the rear end of the second inclination unit to sense a user's feet on the multiple steps and send a sensing signal; and a control unit electrically connected to the driving source of the step unit and the sensor to receive the sensing signal of the sensor and determine, with reference to a sensing result, whether to stop the driving source from operating.

2. The stair-climber of claim 1, wherein the inclination unit regulator comprises:

a first motor pivotally connected to the front end of the second inclination unit;

a first bolt having a top end connected to the first motor; and a first sleeve screwed to the first bolt and having a bottom end pivotally connected to the first inclination unit.

3. The stair-climber of claim 1, further comprising a handrail unit movably disposed at the second inclination unit such that the handrail unit is adjusted to the specific angle when the second inclination unit is lifted or lowered.

4. The stair-climber of claim 3, wherein the handrail unit comprises:

two opposing movable upright rods each having a bottom end pivotally connected to the second inclination unit;

two opposing fixed upright rods each having a bottom end fixed to the rear end of the base and positioned behind a corresponding one of the movable upright rods; and two opposing handrail rods pivotally connected to top ends of the movable upright rods and top ends of the fixed upright rods, respectively.

5. The stair-climber of claim 1, wherein the step unit further has a step adjustment frame disposed movably vertically at the second inclination unit and having two opposing lateral boards and a support rod for connecting the two lateral boards, wherein external lateral sides of the lateral boards are connected to the step regulator, wherein a guide wheel holder is disposed on an inner side of each said lateral board, wherein the step unit has multiple guide rods and multiple guide wheels, with each said guide rod disposed at a corresponding one of the steps, and each said multiple guide wheel disposed at two ends of a corresponding one of the guide rods and rotatably inserted into a corresponding one of the guide wheel holders.

6. The stair-climber of claim 5, wherein the step unit comprises:

two opposing front sprockets each pivotally connected to the front end of the second inclination unit through a front axle;

two opposing rear sprockets each disposed at the rear end of the second inclination unit through a rear axle; and two chains each winding round the front and rear sprockets, wherein the steps are each pivotally connected to the chains by a step shaft.

7. The stair-climber of claim 6, wherein a front axial hole and a rear axial hole are disposed at front and rear ends of the lateral boards of the step adjustment frame and penetrated by the front and rear axles, respectively, and diameters of the front and rear axial holes are larger than outer diameters of the front and rear axles, respectively.

8. The stair-climber of claim 5, wherein the step regulator comprises:

a second motor pivotally connected to the second inclination unit;

a second bolt having a front end connected to the second motor;

a second sleeve screwed to the second bolt; and a bracket pivotally connected to a rear end of the second sleeve and connected to the lateral boards of the step adjustment frame.

9. The stair-climber of claim 8, wherein the bracket comprises:

a rail holder disposed on the bottom surface of the second inclination unit and having a rear end fixed to the rear end of the second inclination unit;

a rail disposed on a lateral side of the rail holder;

a slide table disposed at the rail and slidable forward and backward;

a linkage unit connected to a top side of the slide table and pivotally connected to the rear end of the second sleeve; and two opposing linkage arms each having top and bottom ends pivotally connected to the lateral boards of the step adjustment frame and an end of the linkage unit by a first pivot and a second pivot, respectively.

10. The stair-climber of claim 9, wherein two limiting slots are disposed on left and right sides of the second inclination unit and penetrated by the second pivots slidable forward and backward, respectively.

* * * * *